United States Patent [19]

Forbes et al.

[11] Patent Number: 4,730,406

[45] Date of Patent: Mar. 15, 1988

[54] BOLT RELEASE TRIGGER SAFETY MECHANISM FOR FIREARMS

[75] Inventors: Melvin D. Forbes, Granville; William F. Malone, Jr., Morgantown, both of W. Va.

[73] Assignee: Ultra Light Arms, Inc., Granville, W. Va.

[21] Appl. No.: 680,328

[22] Filed: Dec. 10, 1984

[51] Int. Cl.[4] ..... F41C 17/08

[52] U.S. Cl. ..... 42/70.01; 42/70.05

[58] Field of Search ..... 42/70 R, 70 C, 70 D, 42/70 E

[56] References Cited

U.S. PATENT DOCUMENTS

| | | | |
|---|---|---|---|
| 2,514,981 | 7/1950 | Walker et al. | 42/70.01 |
| 2,595,834 | 5/1952 | Fleenor | 42/70.01 |
| 2,869,269 | 1/1959 | Couture | 42/70 E |
| 3,138,888 | 6/1964 | Brewer | 42/70 E |

*Primary Examiner*—Deborah L. Kyle
*Assistant Examiner*—Michael J. Carone
*Attorney, Agent, or Firm*—Duckworth, Allen, Dyer

[57] ABSTRACT

This invention is an integrated three-position or three-stage safety mechanism for firearms that allows the release of a locked breech bolt mechanism while a Safety Lever is in the "Safe" (Position No. 1) or no fire position, when the trigger and/or the sear mechanism is locked. While in Position No. 1, the safety mechanism allows the firearms' handler or user the ability to depress the Safety Level (Position No. 2) to release, lift, rotate, open, and/or remove the bolt assembly as desired. The design of the Safety mechanism prohibits the operator from inadvertently moving the Safety Lever to the OFF or "Fire" position (Position No. 3), while depressing the Safety Lever (Position No. 2) to release the bolt assembly. This allows removal of the "live" or empty cartridges while the Safety Lever is locked and blocked in the "Safe" or OFF position, thus significantly enhancing the safety of this operation.

This invention is an adaptable enhancement to firearms that use the older or recent two-stage top or side safety trigger blockage or sear blockage safety devices, thus enhancing the safety and handling features on a wide variety of firearms. The adaptation of this invention as an enhanced safety replacement device is a simple task for a qualified gunsmith or one skilled in the art of firearm repairs.

1 Claim, 5 Drawing Figures

BOLT RELEASE TRIGGER SAFETY MECHANISM FOR FIREARMS

FIELD OF THE INVENTION

This invention relates to firearms and has particular reference to means for controlling the firing, handling, and related safety thereof.

BACKGROUND DISCUSSION

Many modern day sporting and military firearms employ a breech closing bolt which has a reciprocating movement in opening and closing the breech and which may be locked in the closed position by any applicable suitable method.

Historically, firearm safeties have functions under one or two basic concepts, e.g. (1) blockage of the firing pin striker assembly, or (2) blockage of the trigger or sear on trigger mechanism safeties.

A suitable fire control for most firearms provides for a readily operable means for locking the firing pin positively in a "Safe" position, as well as a trigger controlled sear to permit the instant release of the firing pin when it is desired to fire or discharge the projectile from the weapon see for example U.S. Pat. No. 2,514,981. To this end it has been found to be essential that the safety device be so arranged that an inadvertent operation of the trigger while the safety is in "Safe" position will not condition the firearm to fire upon the release of the safety. It has also been further determined that a safety device should be capable of being actuated to allow release and rotation of the breach bolt assembly while in the "Safe" position where the sear or trigger mechanism is locked, preventing the firearm from firing, so that such firearm might be rendered free of its cartridges and/or the removal of the bolt assembly from the action, thus further enhancing the handling and storage safety of the firearm.

It is contemplated that these objects may be best attained by mounting on the receiver a trigger housing having two members which prevent movement of the firing pin. One of the members may be conveniently identified as a safety inner arm and the other the sear. A safety lever is arranged to move the safety and the inner arm to prohibit sear movement arranged to prevent movement of the sear. Controlling the movement of the sear through these members enables the firing pin to operate.

SUMMARY OF INVENTION

It is an object of this invention to provide a fire control device having a three-position or three-stage safety which operates by positively moving the firing pin rearwardly out of contact with the trigger assembly and there releasably retaining it. In this way, should the trigger be operated while the safety is engaged, the trigger and sear springs will immediately reposition the mechanism to catch the firing pin upon release of the safety. Our invention in addition to the above will enable the user to release, lift, and rotate the bolt while the safety is in the "Safe" position, thus preventing the fire-arm from accidentally being discharged. The three-stage safety device while in the "Safe" position with the bolt assembly, trigger, and sear locked can be depressed (Position No. 2), thus releasing the bolt assembly to be rotated, lifted, and/or removed as desired. A further novelty and safety feature of this invention is the inability of safety lever to accidentally be moved forward to the "Fire" position (Position No. 3) while being depressed for the purposes of lifting the bolt handle, rotating or removing the bolt assembly.

The need for the safety improvements and mechanism enhancements provided by this invention is the result of product liability claims that have occurred from accidents and personal injuries resulting from firearms equipped with the older safety mechanisms that require release of the trigger or sear mechanism, or the safety lever in the "Fire" position to rotate and open the bolt assembly from the firearm's breech, or recent two-stage safety mechanisms that do not lock the bolt in either the "Safe" or "Fire" position in order to remove loaded cartridges from the chamber and/or magazine on certain designs. This invention can be adapted to many existing firearms with either the older or recent two-stage top or side safety trigger blockage or sear blockage safety devices, thus enhancing their handling safety, in addition to future manufactured conventional firearm triggers, and custom mechanisms employing trigger block or sear safety device, including side, cross bolt, and tang type trigger safety mechanisms.

DESCRIPTION OF DRAWINGS

The exact nature of the invention as well as other objects and advantages thereof will become clearly apparent from consideration of the specification referring to the accompanying drawings in which.

DETAILED DESIGN DESCRIPTION

Typical safeties for trigger mechanisms are a mechanical means to lock or block the sear and/or trigger in a "Safe" position which will prevent the firearm from firing. This movement typically blocks and/or locks the bolt handle, thus preventing it from being lifted or rotated, maneuvers that are typically required to unload cartridges, remove bolt assembly, et al. These features and acts are typically desired to enhance the use, handling, safety, and storage of the firearms.

By referring and cross referencing to the drawings, that portion of the firearm bolt release three-position or three-stage trigger safety mechanism may be seen which is illustrated to assist those skilled in the art to develop an in-depth understanding of the design and the integral interaction between the components.

Figure 1:
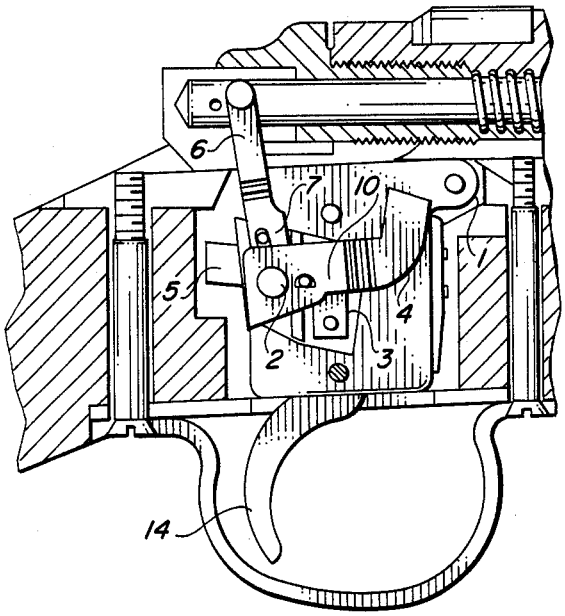
FIG. 1 (Sheet 1 of 3) is a vertical longitudinal sectional view of a portion of firearm assembly, depicting the interface between the stock, action, bolt assembly, trigger, trigger housing, and safety mechanism.

FIG. 1 is a vertical longitudinal integrated sectional view of a conventional firearm action. A typical view of a trigger mechanism is FIGS. 1 and 3 which depict the relationship of the safety mechanism with the external Trigger Housing 1. The attachment to the Trigger Housing is by a cross Assembly Pin 2 having three different diameters, held to the housing by means of a "C" Clip 8.

Figure 3:
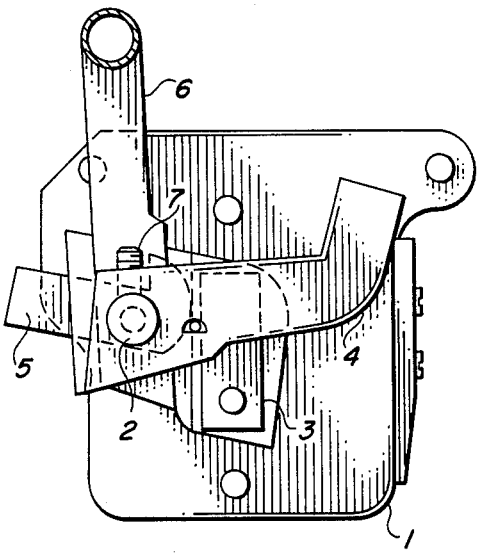
FIG. 3 (Sheet 2 of 3) is a right side view illustration of the integrated trigger and safety mechanism.
Figure 2:
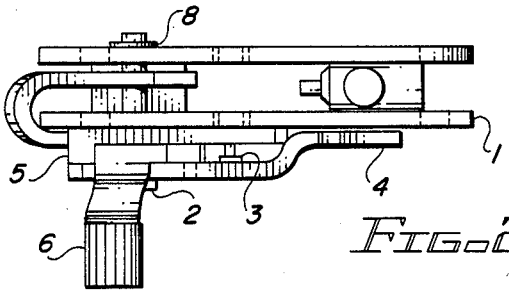
FIG. 2 (Sheet 2 of 3) is a top view of the integrated safety and trigger mechanism.
Figure 4:
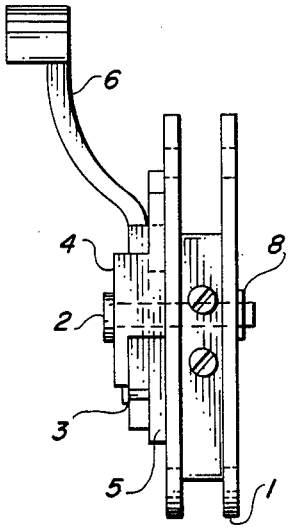
FIG. 4 (Sheet 2 of 3) is a front view of the integrated trigger and safety mechanism.
Figure 5:
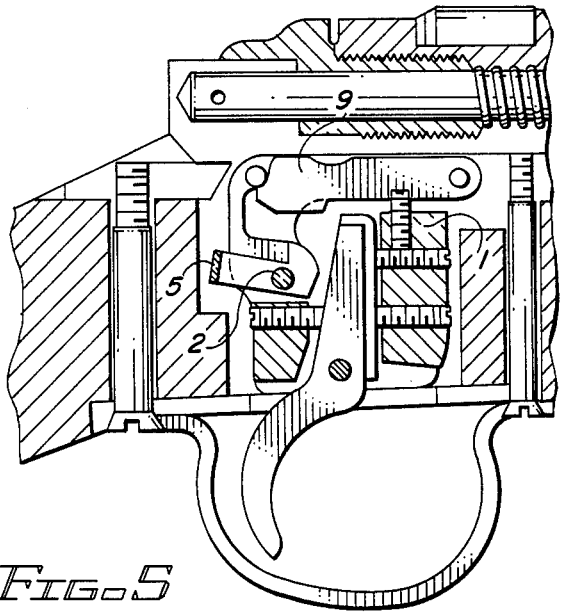
FIG. 5 (Sheet 3 of 3 is a vertical longitudinal section (right side view) depicting the integrated internal trigger and safety component.

FIGS. 2, 3, and 4 are top, right side and front views of the integrated trigger and safety mechanism. By reference to FIGS. 1, 2, 3, 4, and 5, one skilled in the art can readily distinguish the integral functions and features of this invention from the following description.

The Trigger Housing 1 function is to serve as a mounting frame for the safety and trigger components controls. It serves as a pivot for the sear trigger mounting through the trigger housing and firearms action.

The Assembly Pin 2 is a three dimensional pin that aligns and attaches the safety mechanism to the trigger.

The Ball Detent Spring 3 functions to apply pressure to the ball which allows for forward or aft limits on the movement of the safety mechanism.

The Bolt Lock 4 functions to lock or unlock the bolt assembly.

The Safety Inner Arm 5 is a surface that contacts and actually lifts the Sear 9.

The Safety Lever 6 when in the rear position engages the Sear 9, with the Safety Inner Arm 5, and causes the Ball Detent Spring 3, to function.

The Safety Lever Return Spring 7 returns the Bolt Lock 4 to original or "Safe" bolt locked position.

The Assembly Pin "C" Clip 8 purpose is to retain the Safety Assembly to the Trigger Housing 1.

The Sear 9 holds the firing pin until release is actuated by depressing the trigger.

The Transfer Pin 10 is an integral part of the safety Lever 7, engages into an eccentric hole in the Block Lock 4, and provides downward rotation of Bolt Lock 4, when the Safety Lever 6 is positioned in the "Safe" direction. When the Safety Lever 6 is depressed in the "Safe" position, this action results in the release or unlocking of the bolt assembly, allowing it to be lifted, rotated, and/or removed from the action as may be desired.

In conclusion, there has been shown a fire control means for a firearm having a trigger housing and a sear. The trigger housing is equipped with a three-position or three-stage safety assembly which allows the breech bolt assembly to be released, lifted, rotated, and/or removed while the safety lever is in the "Safe" or No Fire position, simply by depressing the safety lever. The safety lever cannot be inadvertently moved to "Fire" or OFF position while depressed to release bolt assembly.

Although a single specific embodiment has been described and illustrated in detail, it should be understood that the invention is not to be considered limited to the exact embodiment disclosed. It is intended that all modifications and equivalents falling with the terms of the appended claims shall be considered as part of the invention.

What is claimed:

1. A safety mechanism for a rifle having a bolt, a sear, a slidable firing pin, and a trigger housing, said mechanism comprising:

a safety lever;

a bolt arm lock;

a safety arm;

said safety lever being moveably mounted onto said trigger housing;

said safety arm being engaged and moveable with said safety lever;

said bolt arm lock being engaged and moveable with said safety lever;

said safety lever being moveable to a first position causing said bolt arm lock to engage the bolt for preventing the bolt from being rotated, and while said safety arm engages the sear for preventing the firing pin from sliding;

said safety lever being moveable to a second position from said first position, said motion to said second position effecting a corresponding movement of said bolt arm lock for releasing said bolt arm lock from the bolt to thereby permit said bolt to be operated or removed while said sliding of said fire pin remains prevented by said safety arm; and said safety lever being moveable to a third position from said first position causing said bolt arm lock to disengage the bolt for allowing the bolt to rotate, and while said safety arm disengages the sear for allowing the firing pin to slide forward.

* * * * *